US008025586B2

(12) United States Patent
Teramoto

(10) Patent No.: US 8,025,586 B2
(45) Date of Patent: Sep. 27, 2011

(54) GOLF CLUB

(75) Inventor: Seiichiro Teramoto, Yukuhashi (JP)

(73) Assignee: Aneeging Golf Ltd., Chiyoda-ku, Tokyo (JP)

( * ) Notice: Subject to any disclaimer, the term of this patent is extended or adjusted under 35 U.S.C. 154(b) by 31 days.

(21) Appl. No.: 12/638,972

(22) Filed: Dec. 15, 2009

(65) Prior Publication Data

US 2010/0160062 A1 Jun. 24, 2010

(30) Foreign Application Priority Data

Dec. 19, 2008 (JP) ..... 2008-008917 U
Sep. 29, 2009 (JP) ..... 2009-225602

(51) Int. Cl.
*A63B 69/36* (2006.01)
*A63B 53/04* (2006.01)

(52) U.S. Cl. ..... 473/221; 473/223; 473/251; 473/334; 473/340; 473/341

(58) Field of Classification Search ..... 473/324–350, 473/219–256
See application file for complete search history.

(56) References Cited

U.S. PATENT DOCUMENTS 3,143,349 A * 8/1964 MacIntyre ..... 473/338
4,121,832 A * 10/1978 Ebbing ..... 473/335
4,655,459 A * 4/1987 Antonious ..... 473/338
4,898,389 A * 2/1990 Plutt ..... 473/223
4,940,236 A * 7/1990 Allen ..... 473/223
5,429,356 A * 7/1995 Dingle et al. ..... 473/251
5,707,298 A * 1/1998 Chovanes ..... 473/223
5,709,610 A * 1/1998 Ognjanovic ..... 473/223
6,095,931 A * 8/2000 Hettinger et al. ..... 473/341
6,224,493 B1 * 5/2001 Lee et al. ..... 473/223
6,375,583 B1 * 4/2002 Solheim ..... 473/329
6,527,649 B1 * 3/2003 Neher et al. ..... 473/248
6,638,175 B2 * 10/2003 Lee et al. ..... 473/223
6,702,689 B2 * 3/2004 Ashton ..... 473/251
6,974,394 B1 * 12/2005 Tang et al. ..... 473/335
7,070,515 B1 * 7/2006 Liu ..... 473/340
7,309,297 B1 * 12/2007 Solari ..... 473/334
2009/0131189 A1 * 5/2009 Swartz et al. ..... 473/221
2011/0021287 A1 * 1/2011 Tucker et al. ..... 473/334

FOREIGN PATENT DOCUMENTS

WO 2008/087762 A 7/2008

* cited by examiner

*Primary Examiner* — Sebastiano Passaniti
(74) *Attorney, Agent, or Firm* — Yokoi & Co., U.S.A., Inc.; Toshiyuki Yokoi

(57) ABSTRACT

A golf club includes a golf club head including a golf club head including a head body and a pair of balance adjustment portions formed in the head body, a plurality of weights detachably retained in each balance adjustment portion so that a three-dimensional gravity center position of the golf club head is adjusted, the weights serving as balancers and differing from each other in density and mass, and an IC chip accommodating portion which is formed in the head body or one of the balance adjustment portions to house an IC chip which stores information on a three-dimensional gravity center position of the golf club head.

12 Claims, 9 Drawing Sheets

GOLF CLUB

CROSS-REFERENCE TO RELATED APPLICATIONS

The present application is related to the Japanese Utility Model Patent Application No. 2008-8917, filed Dec. 19, 2008, and Japanese Patent Application No. 2009-225602, filed Sep. 29, 2009, the entire disclosure of which is expressly incorporated by reference herein.

BACKGROUND OF THE INVENTION

1. Field of the Invention

The present invention relates to a golf club which can easily be customized according to user's inclination, preference or the like and a method for maintenance of the golf club wherein information on the golf club is accumulated and controlled so that a maintenance work can easily be carried out.

2. Description of the Related Art

Conventional golf clubs have been focused on an improvement in a flying distance, and a material for a head of the golf club and design of a loft angle and the like have mainly been emphasized. Accordingly, almost no consideration has been paid to customization (adjustment) according to individual users' preferences or inclinations, physical conditions (age) and the like have.

In view of the circumstances, the assignee of the present application filed a utility model application in Japan as the result of concentrated research, and the application was registered as a Japanese utility model under registration No. 3148909. Japanese utility model registration No. 3148909 discloses a golf club head including a pair of right and left balance adjusting portions in each of which one or a plurality of balancers are housed and covers which detachably cover toe side and heel side backface portions of a head body respectively. The covers include balancer accommodation recesses which surround outer peripheries of the balancers, respectively, and a pair of gravity center height adjustment portions which are formed in each cover in an up-and-down arrangement so as to be located at a crown side and a sole side of the head body respectively and so as to be separated from the balancer accommodation recesses respectively, each gravity center height adjustment portion accommodating one or a plurality of gravity center height adjustment balancers therein.

According to the golf club head of Japanese utility model registration No. 3148909, backspin or topspin can easily be applied to a golf ball by optimally adjusting a gravity center balance in the up-down direction with respect to the head according to player's individuality as well as in the front-back and right-left directions. Thus, the ball can easily be controlled. The golf club head further excels in general versatility, handlability and flexibility in the adjustment of a gravity center that can provide a fine adjustment of the gravity center in a wide range, and a golf club which is provided with the above-described golf club head and excels in the usability and functionality that a flying distance, speed, spin, rolling and the like of a ball can easily be adjusted according to a distance to a cup, a type of lawn grass on the green. The golf club head still further excels in the flexibility in the gravity center adjustment.

However, it is troublesome to select specific gravity (material quality) and mass of each balancer and each gravity center height adjusting balancer and to adjust the gravity center position by combination of the number and arrangement of the balancers and the like. This poses a problem that determination of optimum positions of balancers necessitates a large number of man-hours. In particular, advanced-level players and professional players require fine adjustments. It is troublesome to set the gravity center positions of balancers from the beginning every time a new golf club is purchased or an existing golf club is refurbished. Accordingly, improvements in the ease of maintenance of the golf club have been desired. Furthermore, there is another problem that the gravity center adjustment cannot readily be carried out for a favorite putter or the like.

BRIEF SUMMARY OF THE INVENTION

Therefore, an object of the present invention is to provide a golf club in which balance adjustment of the head thereof can easily be carried out and a method for maintenance of the golf club, in which information on specification of the golf club head customized according to user's inclination or preference, three-dimensional gravity center position and the like are stored so that optimum setting can usually be re-created readily and reliably.

In one aspect of the present invention, there is provided a golf club comprising a golf club head including a head body and a pair of balance adjustment portions formed in the head body, a plurality of weights detachably retained in each balance adjustment portion so that a three-dimensional gravity center position of the golf club head is adjusted, the weights serving as balancers and differing from each other in density and mass, and an IC chip accommodating portion which is formed in the head body or one of the balance adjustment portions to house an IC chip which stores information on a three-dimensional gravity center position of the golf club head.

According to the above-described construction, the head body or the balance adjustment portion is provided with the IC chip accommodating portion which houses the IC chip storing the information on the third-dimensional gravity center position of the golf club head. Accordingly, when the position of gravity center of the golf club head is adjusted by the balance adjustment portion, information on the three-dimensional gravity center position of the golf club head is stored on the IC chip, whereupon the information can be controlled together with the physical golf club head. As a result, after having been deconstructed for the purpose of fine adjustment of the gravity center position, maintenance or the like, the golf club head can quickly be reset to the former gravity center position based on the information on the three-dimensional gravity center position. Consequently, the golf club head excels in the workability in the adjustment of a gravity center and the maintenability.

The head body or the balance adjustment portion formed in the head body is provided with the IC chip accommodating portion in which the IC chip is accommodated. Accordingly, the golf club head and the information on the three-dimensional gravity center position stored on the IC chip can be controlled by corresponding to each other in a one-to-one relation. As a result, even when a golf club shaft has been detached or replaced by another, the information on three-dimensional gravity center position remains and can effectively be used by taking the information from the IC chip at any time as necessary until the golf club head is disposed of. Consequently, the golf club excels in data handlability, effective usability and exactness in data control.

Furthermore, since the IC chip is housed in the IC chip housing of the golf club head, the IC chip housing and the IC chip are normally united together. Consequently, the IC chip can be prevented from being lost or from other troubles.

In another aspect of the invention, there is provided a method for maintenance of a golf club which includes a golf club head including a head body and a plurality of balance adjustment portions formed in the head body and including weights which have different densities and mass and are detachably retained to adjust a third-dimensional gravity center position, wherein information on a three-dimensional gravity center position of the golf club head adjusted by the balance adjustment portions is stored on an IC chip accommodated in an IC chip accommodating portion, the method comprising updating the three-dimensional gravity center position stored on the IC chip when a three-dimensional gravity center position of the golf club head has been adjusted by the balance adjustment portion.

The above-described method includes an information updating step of updating the three-dimensional gravity center position stored on the IC chip when a three-dimensional gravity center position of the golf club head has been adjusted by the balance adjustment portion. Accordingly, the information on a three-dimensional gravity center position can normally be maintained in an updated state as well as the golf club head. Even when one or more of the balancers or the gravity center position adjustment balancers have been lost or the user or the like cannot rearrange the balancers during maintenance, the original gravity center position can quickly be reconstructed based on the information on the three-dimensional gravity center position. Consequently, the above-described method excels in the workability of gravity center adjustment and the maintainability.

BRIEF DESCRIPTION OF THE DRAWING

In the accompanying drawings.

DETAILED DESCRIPTION OF THE INVENTION

Figure 1:
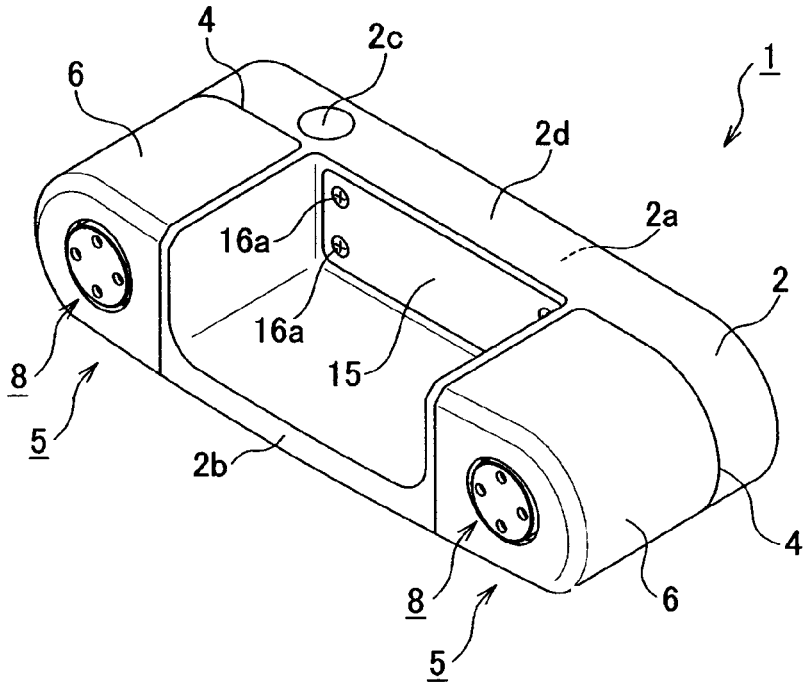
FIG. 1 is a perspective view of a golf club head used with a golf club of one embodiment as viewed at the top.

One embodiment will be described with reference to the accompanying drawings. A golf club head used in the golf club of the embodiment will first be described. Referring to FIG. 1, reference symbol "1" designates a golf club putter head for use with the golf club of the embodiment. Reference symbol "2" designates a head body of the golf club head 1. Reference symbol "2*a*" designates a face of the golf club head 1. Reference symbol "2*b*" designates a backface of the golf club head 1. Reference symbol "2*c*" designates a shaft insertion hole formed in a crown 2*d* side of the golf club head 1. Reference symbol "5" designates a pair of balance adjustment portions provided at both sides of the backface of the golf club head 1. The balance adjustment portions 5 serve as one of balance adjustment portions including notch-like balancer housings 4 and covers 6 detachably covering the balancer housings 4 respectively. The balancer housings 4 are formed in corners in toe and heel sides of backface 2*b* side of the head body 2 respectively. Reference symbol "8" designates cover fixing screws for fixing the respective covers 6 to the head body 2.

Figure 2:
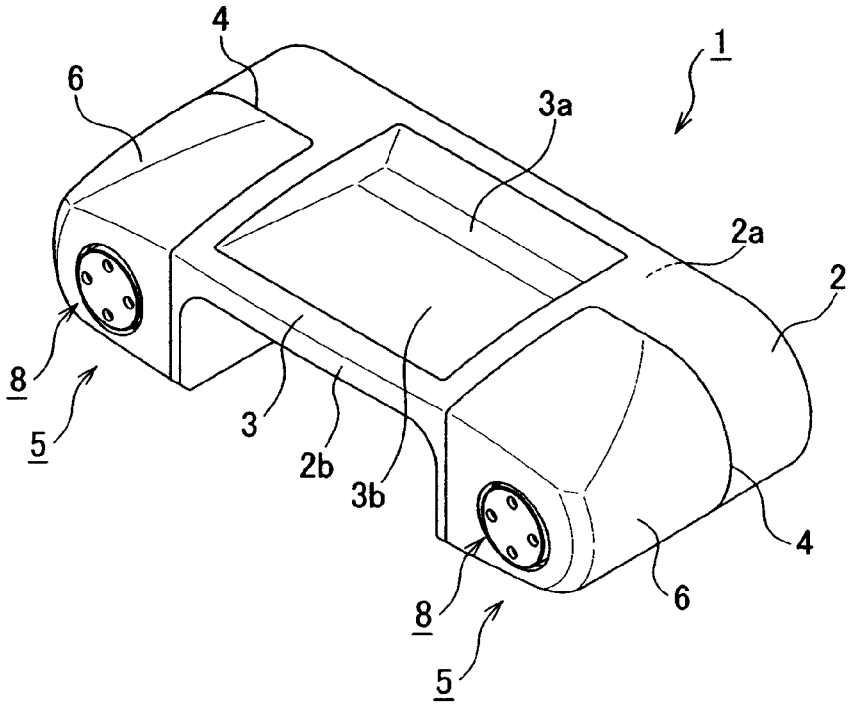
FIG. 2 is a perspective view of the golf club head as viewed at the bottom.

Referring to FIG. 2, reference symbol "3" designates a sole of the golf club head 1. Reference symbol "3*a*" designates a recess formed in a central portion of the head body 2 between toe and heel sides of the sole 3, and reference symbol "3*b*" designates an inclined portion which is formed by engraving from the backface 2*b* side in the recess 3*a* so that the face 2*a* of the head body 2 becomes deeper. The depth of the recess 3*a* is set so as to range from 2 mm to 6 mm, although the depth can be selected according to a type of golf club, size number, user's preference, habit or inclination or the like. The position of a gravity center of the head body 2 becomes lower as the depth of the recess 3*a* is set so as to be shallower than 2 mm, whereupon a golf ball tends to be easily braked with a backspin. As a result, the golf club tends to be difficult to cope with long- and middle-distance putting. On the other hand, the gravity center position of the head body 2 becomes higher as the depth of the recess 3*a* is set so as to be deeper than 6 mm, whereupon the ball tends to be easily accelerated with topspin. As a result, the controllability is reduced such that the golf club tends to be difficult to cope with the short-distance putting.

Figure 3:
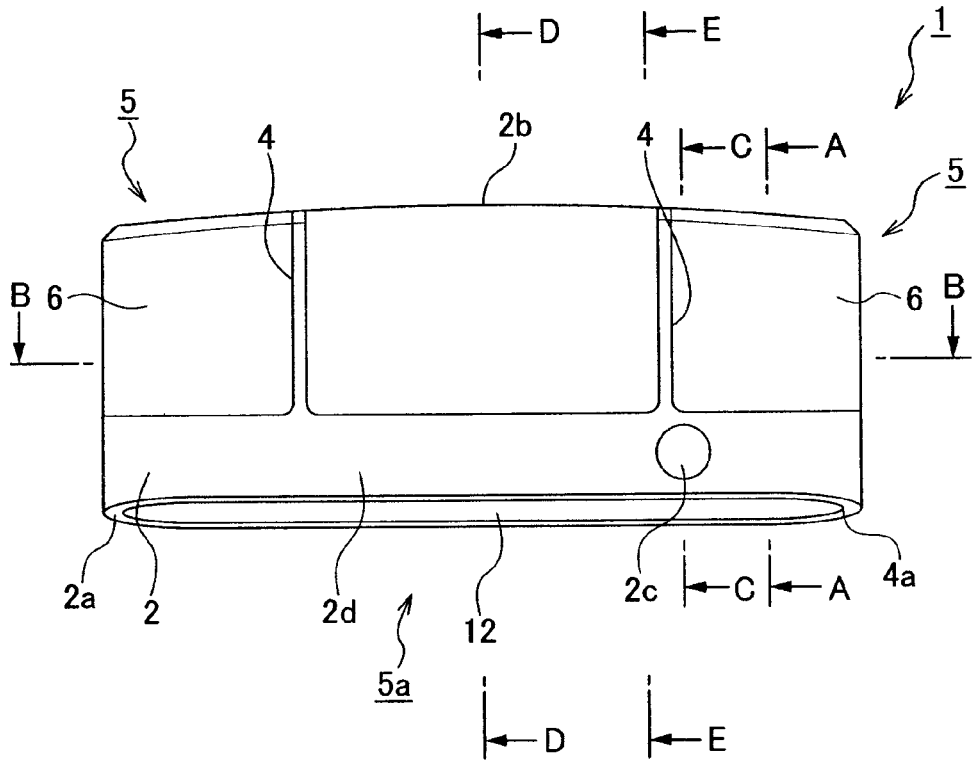
FIG. 3 is a plan view of the golf club head.
Figure 4:
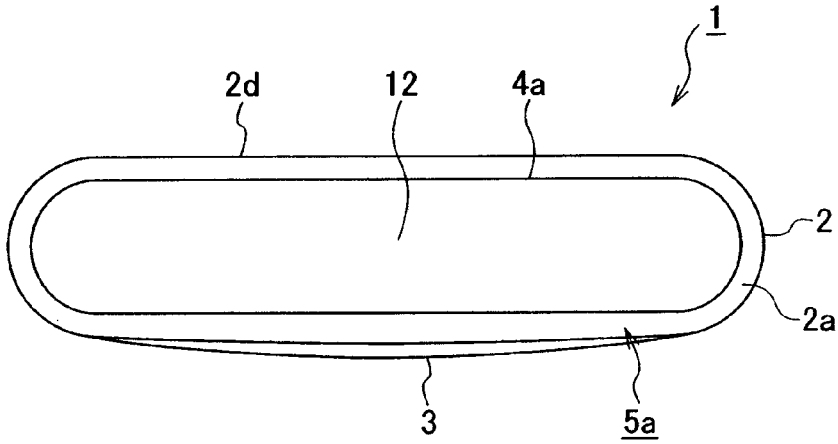
FIG. 4 is a front view of the golf club head.

Referring to FIGS. 3 and 4, reference symbol "5*a*" designates a clubface side balance adjustment portion including a clubface side recess 4*a* formed in the clubface side 2*a* side of the golf club head 2 and a clubface plate 12 detachably covering the clubface side recess 4*a*. The clubface side balance adjustment portion 5*a* serves as one balance adjustment portion.

Figure 5:
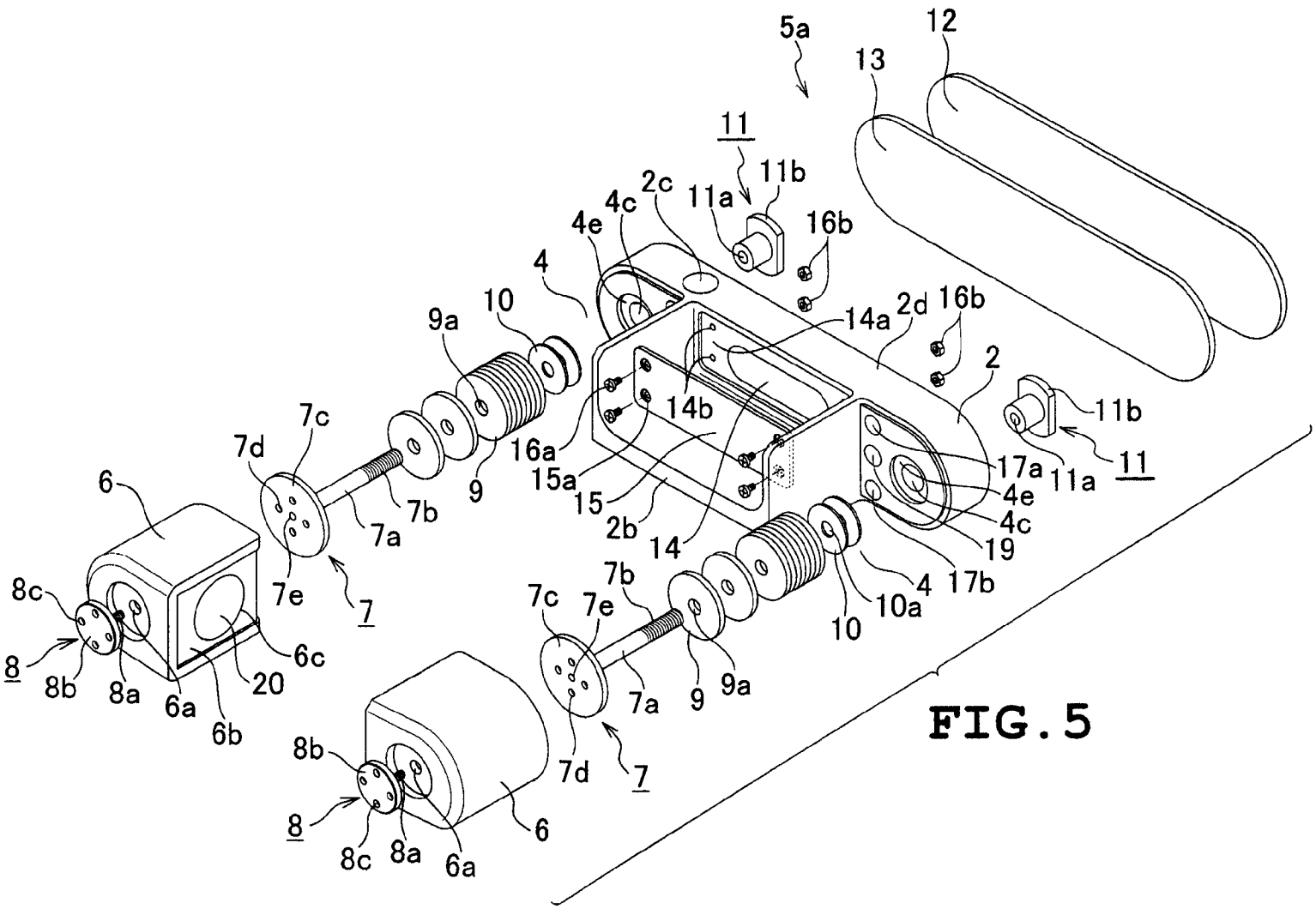
FIG. 5 is an exploded perspective view of the golf club head.
Figure 6:
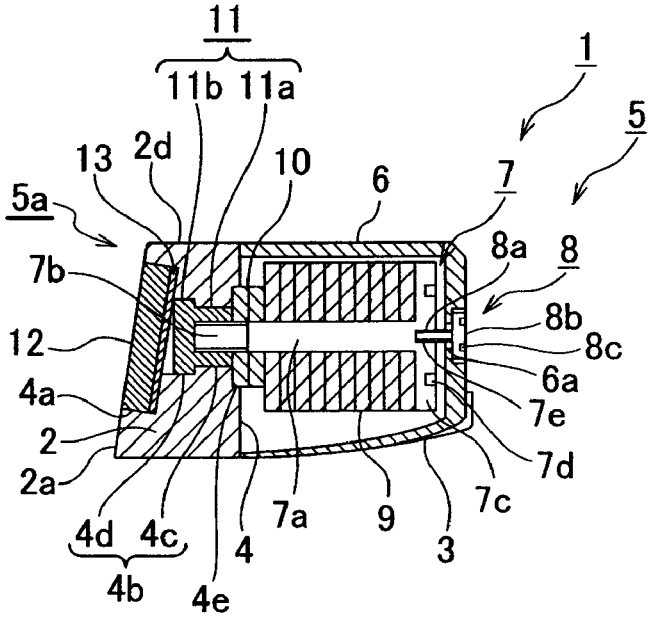
FIG. 6 is a section taken along line A-A in FIG. 3.

The golf club head will now be described in detail. Referring to FIGS. 5 and 6, reference symbol "4*b*" designates two female screw accommodating recesses (FIG. 6) which are formed in the clubface 2*a* side of the clubface recess 4*a* so as to positionally correspond to the balancer housings 4 respectively. Female screw members 11 are adapted to be detachably fitted into the female screw accommodating recesses 4*b* respectively. Reference symbol "4*c*" designates female screw insertion portions of the accommodating recesses 4*b* respectively. Female screw portions 11*a* of the female screw members 11 are inserted through the female screw insertion portions 4*c* respectively. Reference symbol "4*d*" designates rotation-preventing head fitting portions (FIG. 6) formed into a stepped shape at the clubface recess 4*a* side of the female screw insertion portions 4*c* respectively. Rectangular head portions 11*b* of the female screw members 11 are fitted with the head fitting portions 4*d* respectively. Reference symbol "4*e*" designates connecting holes which link the female screw accommodating recesses 4*b* and the balancer housings 4 respectively.

Reference symbol "7" designates balancer fixtures for fixing balancers 9 as will be described later. The balancer fixtures 7 include insertion shafts 7*a* which are inserted through insertion holes 9*a* formed in the central portions of the balancers 9 respectively. The balancer fixtures 7 further include male screw portions 7*b* formed in one of two ends of the insertion shafts 7*a*. The male screw portions 7*b* are threadingly engaged with the female screw portions 11*a* of the female screw members 11 respectively. The balancer fixtures further include head portions 7*c* which have larger outer diameters than insertion holes 9*a* of the balancers 9 respectively. The head portions 7*c* are disposed on the other ends of the insertion shafts 7*a* respectively. Each head portion 7*c* has four tool fitting recesses 7*d* into which a tool (not shown) is inserted so that the balancer fixture 7 is rotated to be attached to and detached from the fitting recess 7*d*. Each head portion 7*c* has a head female screw 7*e* formed in the central portion thereof. Each cover fixing screw 8 is threadingly engaged with each head portion 7*c*.

The cover fixing screws 8 include male screw portions 8*a* which are inserted through through-holes 6*a* formed in the backface 2*b* side of the cover portions 6 to be threadingly engaged with the head female screw portions 7*e* of the balancer fixtures 7 respectively. Each cover fixing screw 8 includes a head 8*b* disposed at one end of each male screw portion 8*a* and four tool fitting recesses 8*c* formed in the head 8*b* so that a tool for rotating the cover fixing screw 8 thereby to attach to or detach from the cover portion 6 is fitted with the recesses 8*c*. Reference symbol "9" designates a plurality of balancers which are weights and are each formed into the shape of a disc and have centrally formed insertion holes 9*a* through which the insertion shafts 7*a* of the balancer fixtures 7 are inserted to be fixed in position.

Spacers 10 are provided between end faces of the balancer housing portions 4 and the balancers 9 for fixing the balancers 9 respectively. The spacers 10 have through holes 10*a* which are formed in the central portion of the spacers 10 and through which the insertion shafts 7*a* are inserted, respectively. A clubface plate 12 is made of a metal such as tungsten, stainless steel or titanium, or a synthetic resin and covers the clubface recess 4*a*. An inner plate 13 is made of a metal having a higher thermal conductivity than the head body 2 and the clubface plate 12. The inner plate 13 is disposed between the clubface plate 12 and the clubface recess 4*a* and detachably bonded to the clubface plate 12 and the head body 2. A communication hole 14 is formed in a part of the head body 2 located at the backface 2*b* side and communicates with the clubface recess 4*a*. A cover plate fitting recess 14*a* is formed in the wall of the head body 2 which is formed with the communication hole 14 and is located at the backface 2 side. A plurality of fixing bolt insertion holes 14*b* are formed in the bottom of the cover plate fitting recess 14*a* so as to be located at corners of the bottom.

A cover plate 15 is detachably fitted with the cover plate fitting recess 14*a* thereby to close the communication hole 14. The cover plate 15 has four fixing holes 15*a* which are formed in four corners thereof so as to correspond to the fixing bolt insertion holes 14*b*, respectively. Four fixing bolts 16*a* are inserted through the fixing holes 15*a* of the cover plate 15 and the fixing bolt insertion holes 14*b* in turn to be threadingly engaged with nuts 16*b* fitted with the insertion holes 14*b* at the clubface 2*a* side of the head body 2, thereby fixing the cover plat 15 at the corners thereof, respectively. Two pairs of upper and lower fitting recesses 17*a* and 17*b* are formed in the walls located at the backface 2*b* side of the head body 2 so as to be spaced upward and downward from the centers of the connecting holes 4*e* respectively. Two communication holes 19 to press the inner plate is formed so as to communicate via the balancer housing portions 4 with the clubface recesses 4*a* respectively.

The female screw portions 11 have rectangular heads 11*b* and are fitted into the head fitting portions 4*d* of the female screw accommodating recesses 4*b*, respectively. As a result, when the male screw portions 7*b* of the balancer fixtures 7 are threadingly engaged with the female screw portions 11*a* of the female screw members 11 respectively, the balancers 9 and the spacers 10 can be fixed reliably and tightly. Thus, the golf club excels in the working efficiency and stability in the fixing of the balancers 9 and the spacers 10. Furthermore, when the female screw portions brought into threading engagement with the male screw portions 7*b* of the balancer fixtures 7 are formed directly on the head body 2, the female screw portions are worn out or deformed due to attachment or detachment of the balancer fixture 7. In this case, the head body 2 needs to be replaced by a new one, which lacks in natural energy efficiency and environmental friendliness. However, since only the female screw portions 11 need to be replaced in the embodiment, the golf club excels in long operating life of the head body 2.

Figure 7:
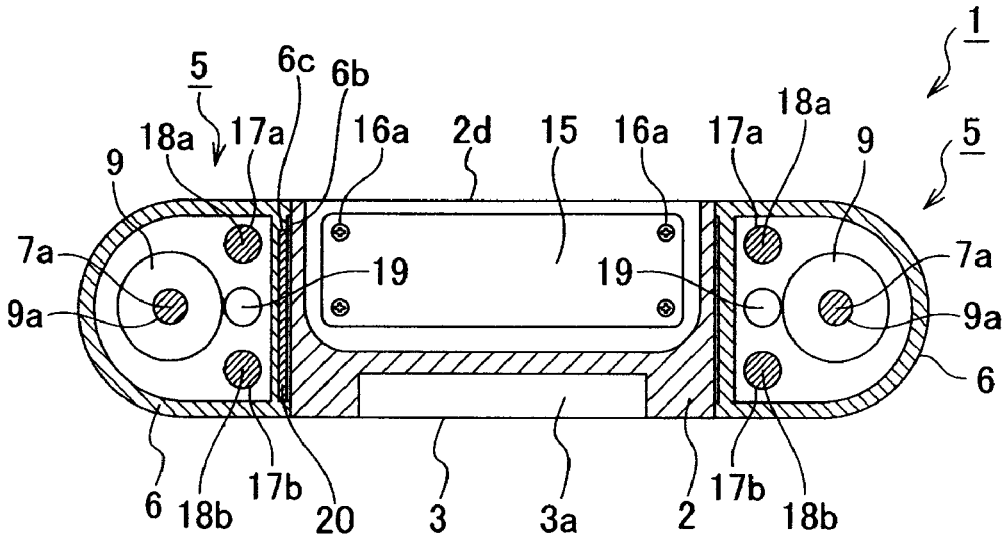
FIG. 7 is a section taken along line B-B in FIG. 3.

Referring to FIGS. 5 and 7, reference symbol "20" designates an IC chip fixed to an IC chip accommodating portion 6*c* formed in a side 6*b* of one of the covers 6 into a recessed shape. The IC chip 20 may be of any type that data can be written thereonto and read therefrom. The embodiment employs an IC tag of non-contact type that data can be written onto and read from the IC tag using radio waves. Accordingly, data can be written and read out when the IC chip 20 is within a communication distance relative to a reader/writer. The IC chip 20 need not be deconstructed and brought into contact with the reader/writer. The IC chip 20 is designed to store information on a product serial number, the mass, a position of gravity center, a loft angle, a sole angle, the mass and length of a shaft, and the like. Furthermore, the product serial number (not shown) is engraved on the head body 2. Accordingly, when data read from the IC chip 20 regarding individual golf club heads is stored and controlled on a computer or server (neither shown), data of each golf club head can be taken out of the computer or server on the basis of the product serial number thereby to be used even in the case where the IC chip 20 is broken. As a result, dimensions, angles, mass of each part need not be re-measured, and the gravity center position need not be re-set, whereupon the above-described data control manner excels in the certainty and reliability of data control. Additionally, materials and mass of a shaft and grip of the golf club may be stored on the IC chip 20. As a result, the mass and gravity center balance of the whole golf club can be obtained.

In the foregoing embodiment, one side 6*b* of the cover 6 opposed to the head body 2 is formed with the recessed IC chip accommodating portion 6*c* in which the IC chip 20 is accommodated. Accordingly, the IC chip 20 is prevented from interfering with the head body 2 and interposed between the sidewall of the cover 6 and the head body 2, whereupon the IC chip 20 can be protected against shock occurred when the ball is hit. Consequently, the above-described data control manner excels in the reliability in data protection. Additionally, the location of the IC chip 20 should not be limited to that described above. The IC chip 20 may be provided at any location where the IC chip 20 is not exposed on the surface of the golf club and the IC chip 20 is less susceptible to external shock during the carrying and use of the golf club under the condition that communication is possible between the IC chip 20 and the reader/writer.

Figure 8:
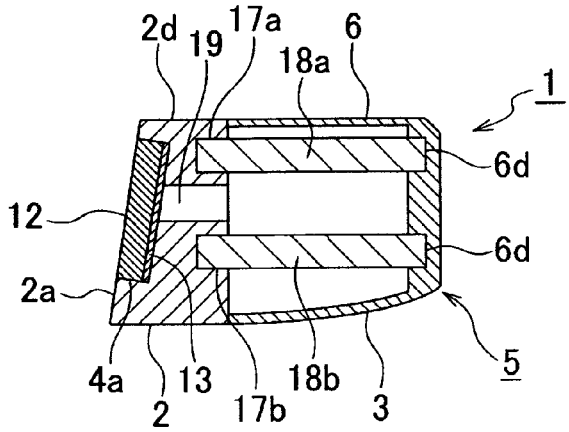
FIG. 8 is a section taken along line C-C in FIG. 3.

Referring now to FIG. 8, a pair of upper and lower balancers 18*a* and 18*b* for adjustment of gravity center height have one ends fitted in fitting recesses 17*a* and 17*b* of the head body 2 in the balance adjustment portions 5 and the other ends fitted in cover side fitting portions 6*d* formed inside the cover portions 6, respectively. As the result of the aforementioned fitting manner of the gravity center height adjustment balancers 18*a* and 18*b*, both ends of the balancers 18*a* and 18*b* can reliably be held, whereupon the golf club excels in fixation stability.

Referring to FIGS. 6 to 8, the position of gravity center height of the golf club head 1 can easily be adjusted by combination of the materials, numbers and locations of the balancers 9 and the gravity center height position adjustment balancers 18*a* and 18*b*. Each one of the balancers 8*a*, 8*b* and 9 may be made of, as a principal component, a metal with a larger specific gravity, such as tungsten (W), brass, iron (Fe), copper (Cu), gold (Au) or the like or a metal with a smaller specific gravity, such as magnesium (Mg), aluminum (Al), titanium (Ti) or the like. Furthermore, each one of the balancers 8*a*, 8*b* and 9 may be made of a combination of a synthetic resin with smaller specific gravity (smaller weight), such as ABS resin, PC resin or the like or a synthetic rubber or the like. Furthermore, a suitable value of density (specific gravity and material quality) and mass of the balancers 9 may be selected, and not all balancers 9 may have the same density and mass. In a similar way, a suitable value of density (specific gravity and material quality) and mass of each of the balancers 8*a* and 8*b* may be selected, and not all balancers 8*a* and 8*b* may have the same density and mass. Additionally, each of the balancers 9, 18*a* and 18*b* may have a rectangular, polygonal outer shape or a combination of these outer shapes.

The balancers 8*a*, 8*b* and 9 may be magnetized. Since a plurality of balancers can be treated together in this case, the balancers can be attached and detached with ease and accordingly, the gravity center can easily be adjusted. Moreover, slight oscillation or vibration can be suppressed, whereupon the golf club excels in the usability. Not all the balancers need to be magnetized. Magnetized balancers and non-magnetized balancers may be used in combination. The covers covering the respective balancers 8*a*, 8*b* and 9 may be made of a shielded material when the balancers are magnetized. The IC chip can be protected when the IC chip housing is provided in any part of the golf club other than the cover.

The gross mass to be adjusted by the balance adjustment portions 5 and 5*a* can suitably be selected. The gross mass to be adjusted by the balance adjustment portions 5 and 5*a* is adjustable when the proportion thereof to the gross mass of the golf club head 1 ranges from 0.5% to 50%. When the aforesaid proportion is less than 0.5%, the effect of balance adjustment tends to become insufficient. When the aforesaid proportion is above 50%, the mass of a single head body 2 becomes excessively small such that the head speed easily tends to be increased in the case where the balancers 9 and the gravity center height adjustment balancers 18*a* and 18*b* are not added. As a result, the braking effect tends to be reduced. Additionally, when the head body 2 is made of a lightweight material such as a synthetic resin, a ratio of the total adjustment mass of the balancer adjustment portions to the total mass of the golf club head can be increased up to the maximum of about 80%.

Since the balance adjustment portion 5 adjusts the gravity center balance by the balancers 9, the cover 6 is desired to be made of a lightweight material. In order that the cover 6 may be prevented from breakage due to an external force, the cover 6 is made of an engineering resin excelling in mechanical strength, such as polycarbonate or a lightweight metal such as magnesium.

Figure 9:
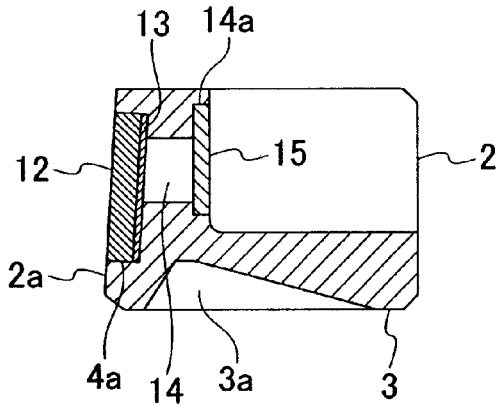
FIG. 9 is a section taken along line D-D in FIG. 3.
Figure 10:
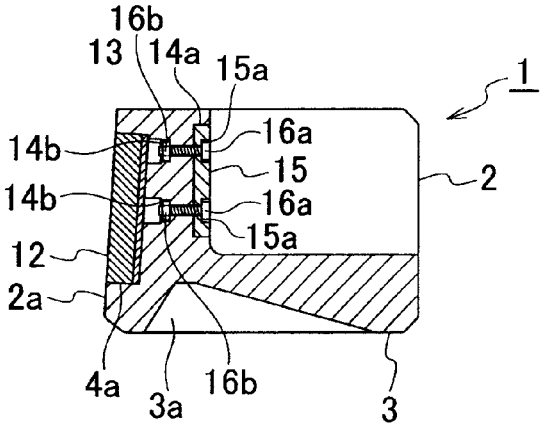
FIG. 10 is a section taken along line E-E in FIG. 3.

Referring to FIGS. 9 and 10, the clubface plate 12, the inner plate 13 and the cover plate 15 are suitably selectable in the shape, size, thickness and the like. The material of the clubface plate 12 may include a metal such as tungsten, stainless steel or titanium. A synthetic rubber or the like may be used. Although the inner plate 13 is made of aluminum in the embodiment, the material of the inner plate 13 should not be limited to aluminum. A metal with a higher thermal conductivity than the head body 2 and the clubface plate 12 may suitably be selected, instead. A metal such as tungsten, stainless steel, titanium, gold or platinum or the like, glass or a synthetic resin may selectively used as the material for play or as the material for display. The user's name or the like may be engraved on the surface of the cover plate 15, or the surface of the cover plate 15 may be decorated with various colors, patterns or the like. Particularly in the case of display use, the surface of the cover plate 15 may be decorated with noble metals, jewels or the like.

The clubface plate 12 and the inner plate 13 are bonded together by an adhesive agent, a double-faced adhesive tape or the like. The inner plate 13 is also bonded to the head body 2 by an adhesive agent, a double-faced adhesive tape or the like. In particular, when a thermoplastic adhesive agent is used, an adhesive layer can be softened by heat application thereby to be easily removed. Consequently, the golf club of the embodiment excels in the usability. Furthermore, the communication hole 14 is formed so as to communicate between the backface 2*b* side of the head body 2 and the clubface recess 4*a* as shown in FIG. 9. Accordingly, when heat is applied via the communicating hole 14 to the inner plate 13 after detachment of the cover plate 15 so that the adhesive layers are softened, the inner plate 13 can easily be removed from the head body 2 and the clubface plate 12. Consequently, the golf club excels in the working efficiency in replacement of the clubface plate 12 and the inner plate 13.

The communication holes 19 through which inner plate 13 is pressed are provided so as to communicate between the respective balancer housing portions 4 and the clubface recess 4*a* as shown in FIGS. 7 and 8. Accordingly, the inner plate 13 can be pressed through the communication holes 19 provided at both sides as well as through the central communication hole 14, whereupon the clubface plate 12 and the inner plate 13 can be removed with a smaller force without deformation of the inner plate 13. Consequently, the golf club excels in the removing efficiency. Furthermore, since the cover plate 15 is fixed to the head body 2 by the fixing bolts 16*a* and the nuts 16*b* by a threading engagement manner as shown in FIG. 10, the attaching and detaching works can easily be carried out, whereupon the golf club excels in the assembly and disassembly work efficiency, reliability of fixation and stability.

Figure 11:
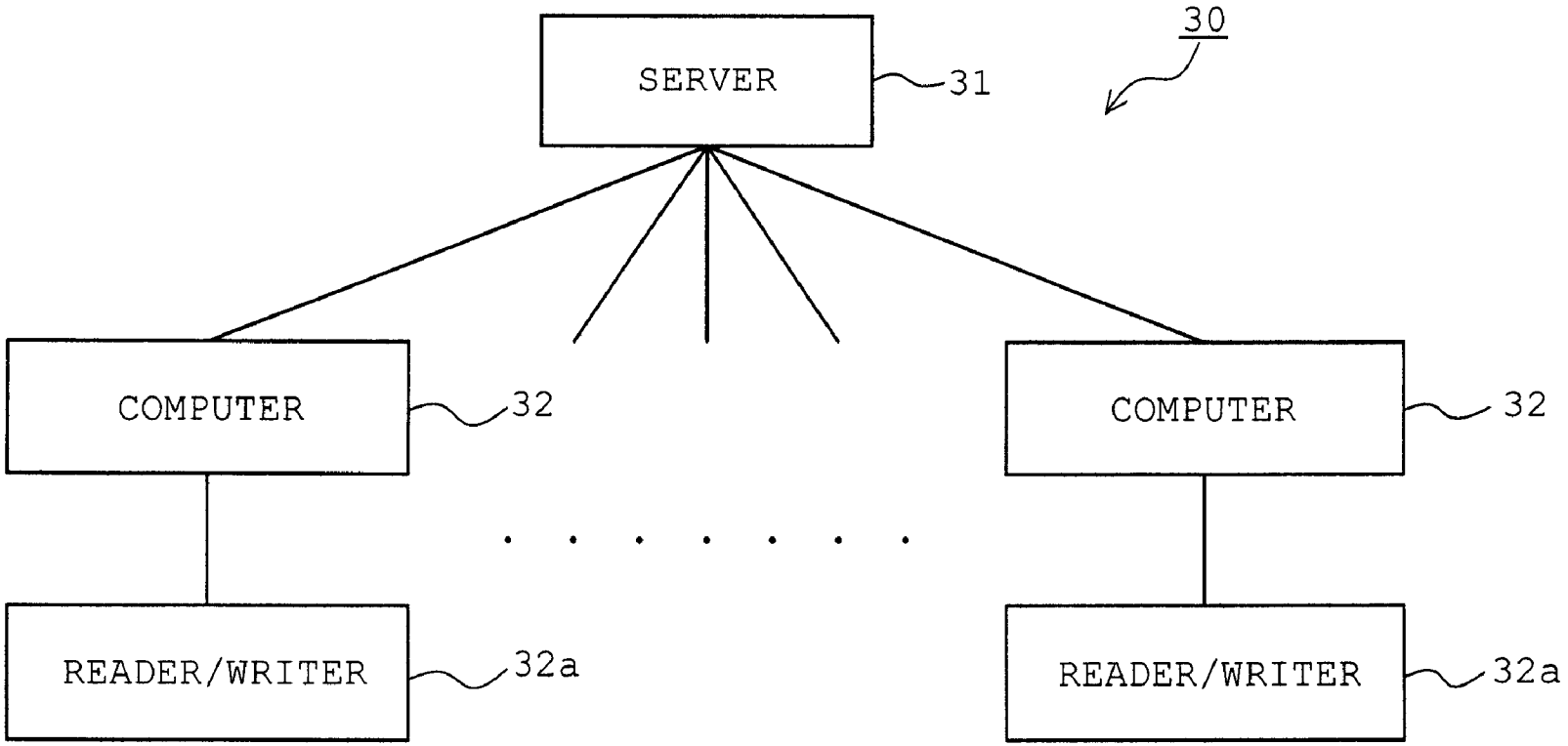
FIG. 11 is a schematic view of an arrangement of maintenance system used in a method for maintenance of the golf club of the embodiment.

The following describes a maintenance system carrying out a maintenance method for the golf club of the embodiment provided with the foregoing golf club head. Referring to FIG. 11, reference symbol "30" designates a maintenance system used in the method for maintaining the golf club of the embodiment. The maintenance system 30 includes a server 31 which consolidates various pieces of information (data) about the golf club of the embodiment possessed by the user and computers 32. The computers 32 are installed in various dealers around the world and are connected to the server 31 via various transmission lines to transmit and receive various pieces of information through the Internet. Reader/writers 32*a* are connected via universal serial bus (USB) connection cables or the like to the computers 32 to communicate with the IC chip 20 (see FIGS. 5 and 7) incorporated in the golf club head 1 of the golf club of the embodiment, thereby reading and writing data from and onto the IC chip 20, respectively.

Figure 12:
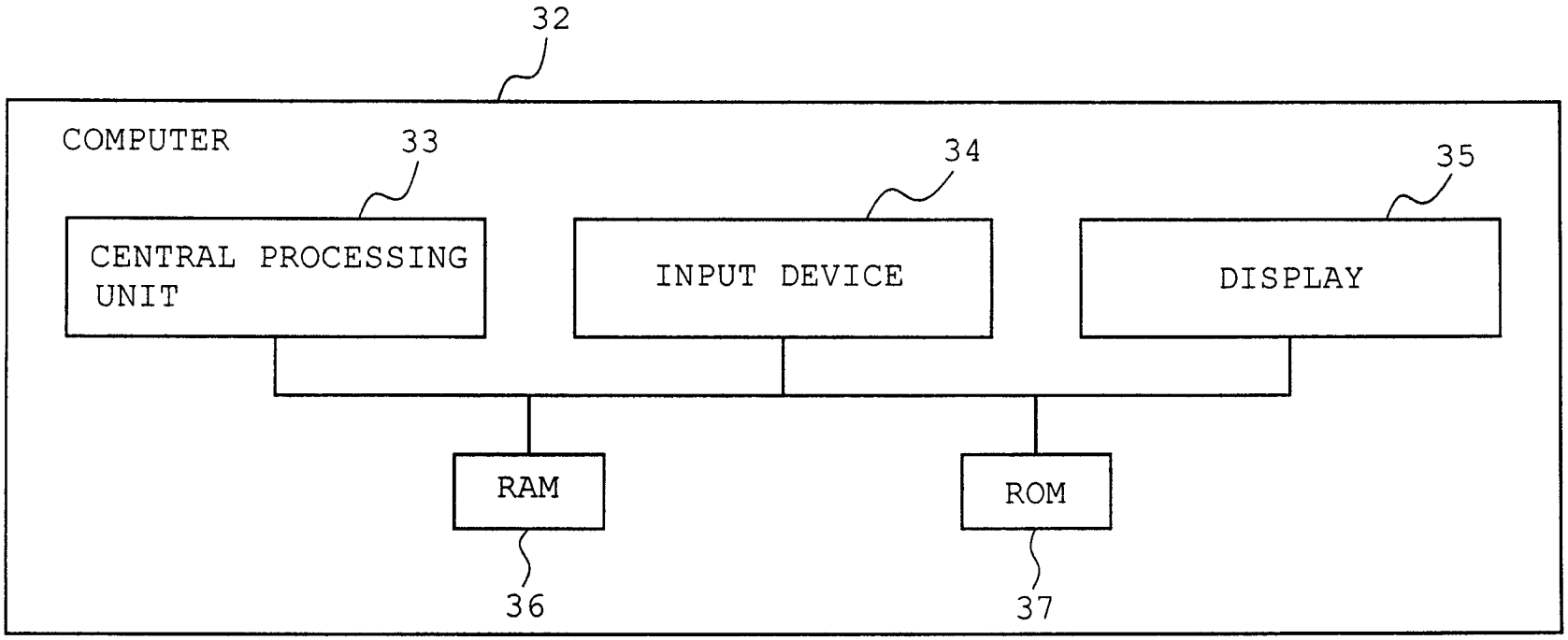
FIG. 12 is a schematic block diagram of a computer of the maintenance system.

The computers 32 of the maintenance system 30 will be described with reference to FIG. 12. Each computer 32 includes a central processing unit (CPU) 33, an input device 34, such as a keyboard or a mouse, provided at each dealer or the like for a maintenance instructor to input necessary data and send an instruction to the computer 32, a display 35, such as a monitor, displaying various pieces of information (data) in the form of characters and images, a random access memory (RAM) 36 which stores the information sent from the reader/writer 32*a* and data delivered from the input device 34, and a read only memory (ROM) 37 which stores a program executed during start-up of the computer 32. The information displayed by the display 35 includes information on the three-dimensional gravity center position of the golf club head and information on the specification of the golf club head, both pieces of information being read from the IC chip 20 by the use of the reader/writer 32*a*.

Figure 13:
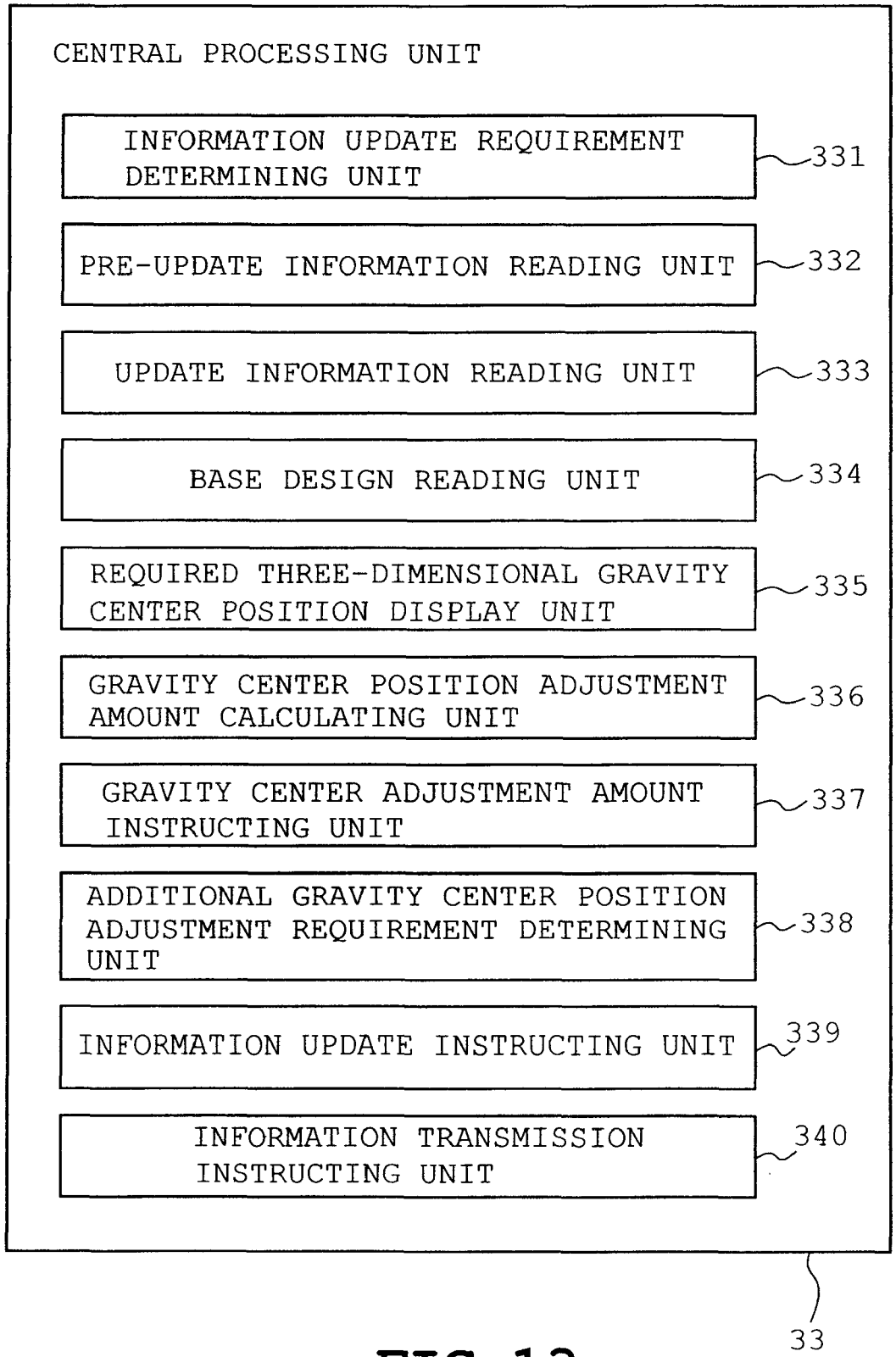
FIG. 13 is a block diagram showing units realizing functions of a central processing unit of the maintenance system.

Means accomplishing functions of the CPU will now be described with reference to FIG. 13. Referring to FIG. 13, the CPU 33 includes an information update requirement determining unit 331 which determines whether the user or instructor has required information update via the input device 34 regarding various pieces of information including personal information on the user stored on the IC chip 20 of the golf club head 1 and three-dimensional gravity center position information on the golf club head 1. The CPU 33 also includes a pre-update information reading unit 332 which reads via the reader/writer 32*a* various pieces of pre-update information stored on the IC chip 20 or reads via the Internet various pieces of pre-update information stored on the server 31. The CPU 33 further includes an update information reading unit 333 which reads the personal information, the information on the specification and the information on the three-dimensional gravity center position all of which the user or instructor has required via the input device 34.

The CPU 33 further includes a base design reading unit 334 which reads from the server 31 information on design of the head body 2 which serves as a base for adjustment of gravity center. The aforesaid information on design of the head body 2 includes values of a material of the head body 2, a gravity center position of the single head body 2, a loft angle and a sole angle, all of which values are necessary for manufacture of the head body 2. The CPU 33 further includes a required three-dimensional gravity center position display unit 335 which displays on the display 35 a target three-dimensional gravity center position (required three-dimensional gravity center position) in the form of numeral or image. The CPU 33 further includes a gravity center position adjustment amount calculating unit 336 which calculates an amount of adjustment of a gravity center position from the required three-dimensional gravity center position and the information on pre-update (pre-adjustment) or the latest gravity center position.

The CPU 33 further includes a gravity center adjustment amount instructing unit 337 which instructs the display 35 so that the mass, numbers and positions of the balancers 9 and the gravity center height adjustment balancers 18*a* and 18*b* to be added or removed are displayed based on the amount of adjustment of the gravity center position obtained by the gravity center position adjustment amount calculating unit 336. The CPU 33 further includes an additional gravity center position adjustment requirement determining unit 338 which determines whether the user or instructor has required additional adjustment of gravity center position, after execution of gravity center adjustment based on the instruction delivered from the gravity center adjustment amount instructing unit 337. The CPU 33 further includes an information update instructing unit 339 which instructs to write, via the reader/writer 32*a* onto the IC chip 20 of the golf club head, the user's personal information to be updated and the information on the three-dimensional gravity center position obtained after confirmed adjustment (change). The CPU 33 further includes an information transmission instructing unit 340 which instructs to transmit to the server 31 the same information as has been written onto the IC chip 20.

Figure 14:
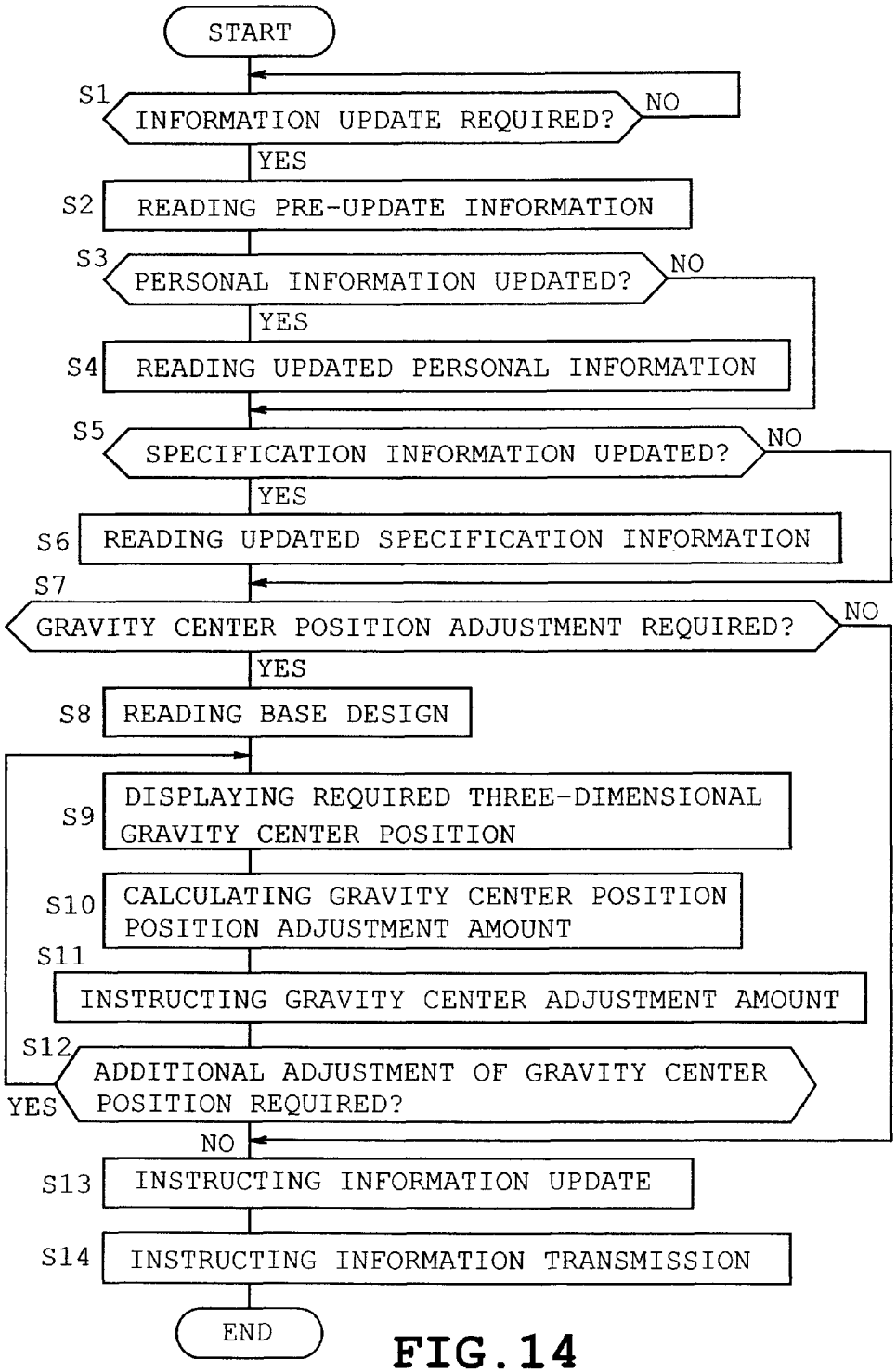
FIG. 14 is a flowchart showing operations of the central processing unit.

The functions accomplished by the aforesaid units 331 to 340 will be described on the basis of operations of the CPU 33. Referring to FIG. 14, the program stored on the ROM 37 is executed upon start-up of the computer 32 shown in FIG. 11 (FIG. 12). The CPU 33 is on standby for requirement of information update from the user or the instructor regarding various pieces of information including the user's personal information and three-dimensional gravity center position of the golf club head 1 (S1: an information update requirement determining step). The instructor or the like inputs the information update requirement via a keyboard, mouse or the like to the input device 34. The information update requirement is stored on the RAM 36.

When the information update requirement determining unit 331 has determined that the input device 34 requires information update, the pre-update information reading unit 332 reads via the reader/writer 32*a* (see FIG. 12) or the Internet the aforesaid information stored on the IC chip 20 or the server 31 (see FIG. 11; and S2: a pre-update information reading step). The information read by the pre-update information reading unit 332 is stored on the RAM 36. Information on the specification (initial values) of the golf club head 1 is read in the case of initial information update requirement. The aforesaid information on the specification is stored on the IC chip 20 or the server 31 and includes the mass of the head body 2, dimensions of various parts of the head body 2 and an initial gravity center position. Subsequently, the information update requirement determining unit 331 determines whether the input device 34 has required update of personal information (S3: a personal information update determining step). When the information update requirement determining unit 331 determines that the input device 34 has required update of the personal information, the update information reading unit 333 reads the personal information into the RAM 36 (S4: an update personal information inputting step). The user's name, the user registration number and the like are read in the embodiment.

When determining that the input device 34 has not required update of the personal information, at step S5 or after the specification update information reading step S4 has been completed, the information update requirement determining unit 331 determines whether the input device 34 has required update of the information on the specification (S5: a specification information update determining step). When the information update requirement determining unit 331 determines that the input device 34 has required update of personal information, the update information reading unit 333 reads information on the update specification (S6: an update specification information reading step). In the embodiment, the update information reading unit 333 reads a lie angle, a loft angle, a sole shape and angle, mass and gravity center position of the head body and the like.

Subsequently, when the information update requirement determining unit 331 determines at step S5 that the input device 34 has not required update of the information on the specification or after the update specification information reading step S6 has been completed, the information update requirement determining unit 331 determines whether the input device 34 has required adjustment of the brevity center position (S7: a gravity center position adjustment requirement determining step). When determining that the adjustment of a gravity center position has been required, the information update requirement determining unit 331 reads information on design similar to the specification of head body 2 serving as a base for the gravity center position adjustment from the server 31 into the RAM 36 (S8: a base design reading step). When determining at step S5 that the input device 34 has not required update of specification information, base design is selected based on the information on the specification read at step S2. When determining at step S5 that the input device 34 has required update of the information on the specification, the information update requirement determining unit 331 selects a base design based on new specification information read at step S6.

Subsequently, the required three-dimensional gravity center position display unit 335 activates the display 35 (see FIG. 12) so that the three-dimensional gravity center position (required three-dimensional gravity center position) to be updated, which has been required to be adjusted at step S7, is displayed in the form of numeric values and images. As a result, the user or the instructor can confirm the required three-dimensional gravity center position on the screen of the display 35. A manner of displaying the required three-dimensional gravity center position may arbitrarily be selected. When displayed as a bright spot superposed on a three-dimensional image of the golf club head 1, the golf club excels in the visibility. However, the bright spot may be superposed on a two-dimensional image of the golf club head 1, instead.

Subsequently, the gravity center position adjustment amount calculating unit 336 calculates an amount of adjustment of the gravity center position from the required three-dimensional gravity center position and the current or information on a pre-adjustment three-dimensional gravity center position (S10: a gravity center position adjustment amount calculating step). Based on the amount of adjustment of the gravity center position calculated by the gravity center position adjustment amount calculating unit 336, the gravity center adjustment amount instructing unit 337 displays, on the display 35, the material and mass of the clubface plate 12 to be used or the balancers 9 to be added or detached and the mass, numbers and positions of the gravity center height adjustment balancers 18*a* and 18*b*, thereby instructing the instructor to adjust the gravity center (S11: a gravity center adjustment amount instructing step). The instructor then changes the material and mass of the clubface plate 12 or the balancers 9 and the mass, numbers and positions of the gravity center height adjustment balancers 18*a* and 18*b*, whereupon the position of gravity center can easily be adjusted. The user then makes a practice swing or tries to hit balls using the golf club had 1 whose gravity center has been adjusted, whereupon the user can check if the requirement can be met.

Subsequently, after the gravity center position has been adjusted based on the instruction by the gravity center adjustment amount instructing unit 337, the additional gravity center position adjustment requirement determining unit 338 determines whether additional adjustment of the gravity center position has been required, based on presence or absence of input of additional adjustment requirement form the input device 34 (S12: an additional gravity center position adjustment requirement determining step). When the additional gravity center position adjustment requirement determining unit 338 determines that the input device 34 has the required additional adjustment of the gravity center position, the CPU 33 returns to step S9 to repeat the additional adjustment of the gravity center position according to steps S10 and S11 until determining that the input device 34 has not required additional adjustment of gravity center position. As a result, a fine adjustment of the three-dimensional gravity center position can be carried out until the user's requirement is met.

When it is determined at step S12 that the input device 34 has not required the additional adjustment of a gravity center position, the information update instructing unit 339 instructs the user to write the information on the adjusted or changed three-dimensional position together with the user's personal information and the information on both to be updated (S13: an information updating step). As a result, the user's personal information, the information on the specification of the golf club head 1 and the information on the three-dimensional gravity center position can be controlled in a normally up-to-date state together with the golf club head 1 with these pieces of information being interrelated. The information on the three-dimensional gravity center position includes materials and thicknesses of the clubface plate 12 and the cover plate 15 and the like relating to the gravity center position other than the mass, numbers and positions of the balancer 9 and the gravity center height adjustment balancers 18*a* and 18*b*.

Finally, the information transmission instructing unit 340 instructs to transmit via the Internet to the server 31 the same pieces of information as written onto the IC chip 20 at the information updating step S13 (S14: an information transmitting step). Consequently, the server 31 can consolidate various pieces of information on golf clubs possessed by the users around the world.

The golf club 1 constructed as described above will work as follows:

1. The IC chip accommodating portion 6*c* is formed in the cover of the backface side balance adjustment portion 5 formed in the head body 2 as one of the balance adjustment portions. The IC chip 20 stores information on the three-dimensional gravity center position of the golf club head 1. When the gravity center position of the golf club head 1 has been adjusted, information on the three-dimensional gravity center position is stored on the IC chip 20, which is then accommodated in the IC chip accommodating portion 6*c*. Accordingly, the information on the three-dimensional gravity center position can be controlled together with the golf club head. As a result, the gravity center position can be fine adjusted based on the information on the three-dimensional gravity center position stored on the IC chip 20, and even after having been disassembled for the purpose of maintenance or the like, the golf club head 1 can quickly be set to the former gravity center position based on the information on the three-dimensional gravity center position stored on the IC chip 20. Consequently, the golf club of the embodiment excels in the working efficiency in the gravity center adjustment and maintenability.

2. Since the golf club head 1 is formed with the IC chip accommodating portion 6*c*, the golf club head 1 and the information on the three-dimensional gravity center position can be controlled in the manner of one-to-one correspondence. The information on three-dimensional gravity center position is not lost even when a shaft is detached from the golf club head 1 or replaced by another. The information on three-dimensional gravity center position can normally be taken out of the IC chip 20 to be effectively used depending on the user's needs until the golf club head is discarded. Consequently, the golf club excels in data handlability, usability and reliability in data control.

3. The clubface side recess 4*a* is formed in the clubface side of the head body 2 and covered by the clubface plate 12. Accordingly, the gravity center position of the head body 2 can be adjusted in the front-back direction when only the material (the mass) of the clubface plate 12 is selected to be changed. Furthermore, the touch of the golf club head 1 with a ball is adjusted according to the hardness of the clubface plate 12, whereupon the golf club can cope with an inclination of a new user and the like. Consequently, the golf club excels in the workability in the adjustment of gravity center position and the freedom in the design of the golf club head 1.

4. The inner plate 13 is disposed between the clubface plate 12 and the clubface recess 4*a* and is detachably bonded to the clubface plate 12 and the head body 2. Accordingly, the clubface plate 12 and the head body 2 can reliably be bonded together with the inner plate 13 being sandwiched therebetween. Consequently, the golf club excels in the reliability in the fixation of the clubface plate 12.

5. The communication hole 14 is formed in the backface side of the head body 2 so as to communicate with the clubface recess 4*a*. Accordingly, the inner plate 13 can be pressed through the communication hole 14 at the backface side thereby to be removed from the head body 2 together with the clubface plate 12. Consequently, the clubface plate 12 can be used repeatedly without damaging or deforming the same. Thus, the golf club excels in a resource saving property.

6. Heat is applied through the communication hole 14 directly to the inner plate 13 since the communication hole 14 is formed in the backface side of the head body 2 so as to communicate with the clubface recess 4*a*. As a result, the inner plate 13 can easily be removed from the head body 2 and from the clubface plate 12 with a small force. Consequently, the golf club excels in the maintenability of the clubface plate 12 and the inner plate 13 and in the labor saving property in the removal of the plates 12 and 13.

7. The inner plate 13 is made of the metal having a higher thermal conductivity than the head body 2 and the clubface plate 12. Accordingly, heat can be applied to the entire inner plate in a short period of time efficiently, whereupon the adhesive layers on both sides of the inner plate 13 can reliably be softened such that the inner plate 13 can easily be removed from the head body 2 and the clubface plate 12. Consequently, the inner plate 13 and the clubface plate 12 can be prevented from being loaded and being deformed and can be used repeatedly. Thus, the golf club excels in the labor saving property in the removal of the plates 12 and 13 and in the resource saving property.

8. The cover plate 15 detachably covers the backface side of the communication hole 14. Accordingly, raindrops or the like can be prevented from invading through the communication hole 14 during playing. Furthermore, in replacement of the clubface plate 12, the cover plate 15 is detached so that the communication hole 14 is opened thereby to expose the inner plate 13. Heat and pressure can be applied to the inner plate 13 so that the clubface plate 12 is replaced by another. Consequently, the golf club excels in the workability in the maintenance.

9. The gravity center position of the golf club head in the front-back direction can be adjusted by selecting and replacing the material (the mass) of the detachable cover plate 15. The range of adjustment of the gravity center position in the front-back direction can be expanded by the combination of the material (the mass) of the cover plate 15 with the material (the mass) of the clubface plate 12. Consequently, the golf club excels in the freedom in the design of the head body 2 and adjustment of the gravity center position.

10. The material of the cover plate 15 can be selected according to the user's preference or inclination. The cover plate 15 can also be colored, decorated and/or carved according to the user's preference or inclination. Consequently, the golf club excels in a decorative effect.

11. At least one of the materials, densities and mass of the clubface plate 12, inner plate 13 and cover plate 15 is stored on the IC chip 20 as the information on the three-dimensional gravity center position. As a result, an amount of change in the gravity center position can be obtained easily and reliably by replacement of the clubface plate 12, inner plate 13 and cover plate 15 based on the aforesaid information (data). Consequently, the golf club excels in the reliability of data control and maintenability.

12. The backface side balance adjustment portions 5 have the balancer housing portions 4 formed at the toe and heel sides of the backface side of the head body 2 respectively. When the number, material (mass) and arrangement of the balancers 9 to be housed in each balancer housing portion 4 are selected, an optimum position can be selected by fine adjusting the gravity center positions of the head in the right-left and front-back directions in a wide range according to the user's inclination, preference or the like without depending upon the shape of the head body 2. Consequently, the golf club excels in the freedom in the design of the gravity center and general versatility.

13. The backface balance adjustment portions 5 have the covers 6 detachably covering the balancer housing portions 4 respectively. Accordingly, the balancers 9 and the gravity center height adjusting balancers 18*a* and 18*b* can be protected against wind and rain or external force thereby to be prevented from being broken or lost. Consequently, the golf club excels in the usability.

14. The backface balance adjustment portions 5 have the female screw accommodating recesses 4*b* which are formed in the clubface 2*a* sides of the clubface recess 4*a* so as to positionally correspond to the balancer housing portions 4, the female screw members 11 detachably fitted into the female screw accommodating recesses 4*b*, respectively. The backface balance adjustment portions 5 further have the connecting holes 4*e* which connect the female screw accommodating recesses 4*b* and the balancer housing portions 4 respectively. The balancer fixtures 7 are inserted through the insertion holes 9*a* of one or a plurality of balancers 9 housed in the balancer housing portions 4 from both sides of the backface of the head body 2 and the connecting holes 4*e* and are threadingly engaged with the female screw members 11 respectively. Since the balancers 9 can be fixed reliably, the golf club excels in the fixation stability of the balancers 9. The golf club excels in the machining performance since no female screws need to be formed in the head body 2. Even when the female screw members 11 and the balancer fixtures 7 have been worn, deformed or broken, only the female screw members 11 and the balancer fixtures 11 need to be replaced, and the head body 2 can be used for a long period of time. Consequently, the golf club excels in the resource saving and environmental protection.

15. The upper and lower fitting recesses 17*a* and 17*b* are formed in the walls located at the backface 2*b* side of the head body 2 so as to be spaced upward and downward from the centers of the connecting holes 4*e* respectively. The upper and lower gravity center height adjustment balancers 18*a* and 18*b* have one ends fitted in the fitting recesses 17*a* and 17*b* respectively. Accordingly, by selecting one of combinations of materials (mass) and arrangement of the gravity center height adjustment balancers to be fitted in the fitting recesses 17*a* and 17*b* respectively, the gravity center of the head can be adjusted in the up-down direction by the gravity center height adjustment balancers 18*a* and 18*b* in addition to the adjustment of the gravity center position of the head in the front-back and right-left directions by the balancers 9. Thus, the head can easily be customized by the use of three-dimensional gravity center position and the golf club can reliably cope with the user's preference or inclination. Consequently, the golf club excels in the freedom in the gravity center adjustment and general versatility.

16. The IC chip 20 stores as the information on the three-dimensional gravity center position at least one of the materials, densities and mass of the gravity center position balancers 9 and gravity center height adjustment balancers 18*a* and 18*b*, and the arrangement of the gravity center position balancers 9 and gravity center height adjustment balancers 18*a* and 18*b*. An amount of change in the gravity center position can be obtained easily and reliably by the changes of the gravity center position balancers 9 and gravity center height adjustment balancers 18*a* and 18*b* based on the information (data) stored on the IC chip 20. Consequently, the golf club excels in the reliability in the data control and the maintenability.

17. When the gravity center of the whole head is set by the gravity center position balancers 9 and gravity center height adjustment balancers 18*a* and 18*b* so that the clubface side and the sole side are heavier, the clubface tends to hit a part of the ball beneath its centroid (the position on the equator lower than the gravity center). Accordingly, backspin can easily be applied to the ball and the ball can easily be controlled. Consequently, the golf club excels in the usability as the club head for use as a short club head or a putting golf club head for a short distance and fast green.

18. When the gravity center of the whole head is set by the gravity center position balancers 9 and gravity center height adjustment balancers 18*a* and 18*b* so that the crown side and the backface side are heavier, the club face tends to hit the centroid of the ball (a part near the gravity center on the equator) or a part of the ball slightly higher than the centroid. This can reduce loss in the impact and increase a flying distance of the ball.

19. Since the user's personal information and the information on the specification of the golf club head are stored on the single IC chip 20, one or more of these pieces of information can easily be controlled in a manner of correlation. Each piece of information (data) can be read from the IC chip 20 as the need arises and stored and controlled on a computer. Alternatively, the read information can be updated to be written and stored on the IC chip as the latest information. Thus, the information on the user and the golf club head can reliably be controlled without omission. Consequently, the golf club excels in the exactness and reliability of the data control.

20. The IC chip 20 is accommodated in the IC chip accommodating portion 6*c*. Accordingly, since the golf club head is normally accompanied with the IC chip 20, troubles such as loss of the IC chip 20 during maintenance or the like can be prevented.

21. The golf club has the IC chip 20 accommodated in the IC chip accommodating portion 6*c*. Accordingly, when user's personal information and information on the specification of the golf club head are correlated and stored on the IC chip 20, the stored information can easily be controlled together with the golf club head. Each piece of information (data) can be read from the IC chip 20 as the need arises and stored and controlled on a computer. Alternatively, the read information can be updated thereby to be written and stored on the IC chip as the latest information. Thus, the information on the user and the golf club head can reliably be controlled without omission. Consequently, the golf club excels in the exactness and reliability of the data control.

22. Records of sale and purchase and assignment of the golf club head and user's personal history can be stored on the IC chip 20. Accordingly, it can easily and reliably be determined whether the golf club head is a regular product or not (telling the real from the false) and whether the golf club head has been duly traded or not, that is, whether the golf club head is a stolen goods or not. Consequently, the golf club excels in the reliability in the distribution management of the golf club head.

23. Since the golf club has the balance adjustment portions (the clubface side balance adjustment portions and the backface side balance adjustment portion), the three-dimensional gravity center position can properly be modified or changed according to changes in the physical condition, aging and decrease in the physical strength of the user. Consequently, the golf club excels in the general versatility.

The following describes advantageous effects of the method for maintenance of the golf club:

1. The maintenance method includes an information update step of updating information on a three-dimensional gravity center position stored on the IC chip 20 when the three-dimensional gravity center position of the golf club head has been adjusted by the balance adjustment portion. Accordingly, the information on the three-dimensional gravity center position of the golf club head 1 can be controlled in the latest state together with the golf club head. Even when one or more of the gravity center position adjustment balancers 9 or the gravity center height adjustment balancers 18*a* and 18*b* have been lost or the user or the like cannot rearrange the balancers 9, 18*a* and 18*b* during maintenance, the original gravity center position can quickly be reconstructed based on the information on the three-dimensional gravity center position. Consequently, the maintenance method excels in the workability of gravity center adjustment and the maintainability.

2. The maintenance method includes a required three-dimensional gravity center position display step of displaying on a monitor screen the post-adjustment three-dimensional gravity center position required by the user. Accordingly, the user can adjust the gravity center position while visually confirming the three-dimensional gravity center position of the golf club head 1. As a result, the user can intuitively recognize an amount of adjustment of the gravity center position and a direction of adjustment with ease. Consequently, the maintenance method excels in the easiness of the gravity center position adjusting work and the maintenability.

3. The user's personal information and the information on the golf club head specification are updated in the information update step. As a result, both pieces of information can easily be controlled in the manner of correlation. Each piece of information (data) can be read from the IC chip 20 as the need arises and stored and controlled on a computer. Alternatively, the read information can be updated to be written and stored on the IC chip as the latest information. Thus, the information on the user and the golf club head can reliably be controlled without omission. Consequently, the maintenance method excels in the easiness of data control and the maintenability.

4. The maintenance method includes the information read step of reading into the computer the information on the three-dimensional gravity center position, the user's personal information and the information on the specification of the golf club head. Accordingly, various pieces of information possessed by respective users can be read into computers installed in dealers around the world in order that the information may be confirmed or the maintenance work may be carried out for the golf club. Consequently, the maintenance method excels in the maintenability and the reliability in client service.

5. The maintenance method includes the information transmission step of transmitting to the server the information on the three-dimensional gravity center position, the user's personal information and the information on the specification of the golf club head 1 all of which have been updated in the information update step. Accordingly, latest pieces of information on golf clubs possessed by the respective users (updated information) are transmitted by the computers installed in dealers around the world to a server together with users' personal information. As a result, the server can consolidate these pieces of information. Accordingly, when a computer is connected to the server, necessary information can be taken out of the server everywhere at any time to be confirmed or updated and to carry out maintenance of the golf club and other works. Consequently, the maintenance method excels in the workability in the maintenance, general versatility of client service, reliability of data control and the like.

6. The information on three-dimensional gravity center position of the golf club head is appropriately revised according to changes in the physical condition, aging and decrease in the physical strength of the user. Thus, the information on three-dimensional gravity center position of the golf club head can reliably be controlled in the IC chip 20, the server or the like. Consequently, the maintenance method excels in the maintenability and the general versatility of client service.

Although the invention has been described in considerable detail in language specific to structural features or method acts, it is to be understood that the invention defined in the appended claims is not necessarily limited to the specific features or acts described. Rather, the specific features and acts are disclosed as preferred forms of implementing the claimed invention. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It is to be understood that the phraseology and terminology employed herein, as well as the abstract, are for the purpose of description and should not be regarded as limiting.

What is claimed is:

1. A golf club, comprising:

a golf club head including a head body and a pair of balance adjustment portions formed in the head body;

a plurality of weights detachably retained in each balance adjustment portion of the pair of balance adjustment portions so that a three-dimensional gravity center position of the golf club head is adjusted, the plurality of weights serving as balancers and differing from each other in density and mass; and an Integrated Circuit (IC) chip accommodating portion that is formed in the head body or one of the balance adjustment portions to house an IC chip that stores information on the three-dimensional gravity center position of the golf club head, wherein each balance adjustment portion includes a clubface side balance adjustment portion having a clubface recess formed in a clubface side of the head body, a clubface plate covering the clubface recess, an inner plate made of a metal having a higher thermal conductivity than the head body and the clubface plate, located between the clubface plate and the clubface recess and detachably bonded to the clubface plate and the head body, a communication hole formed in a backface side of the head body and communicating with the clubface recess, and a cover plate detachably covering a backface side of the communication hole; and the third-dimensional gravity center position information stored on the IC chip includes at least one of materials, densities and mass of the clubface plate, the inner plate and the cover plate.

2. The golf club according to claim 1, further comprising the IC chip accommodated in the IC chip accommodating portion.

3. The golf club according to claim 2, wherein the balance adjustment portions include respective backface side balance adjustment portions each of which has:

a balancer housing formed in a toe or heel side of a backface side of the head body;

a cover detachably covering the balancer housing;

a female screw accommodating recess formed in a clubface side of the clubface recess so as to correspond to a position of the balancer housing;

a female screw member detachably fitted into the female screw accommodating recess;

a connecting hole which connects the female screw accommodating recess and the balancer housing portion;

a balancer fixture inserted through insertion holes of the balancers and the connecting holes, being threadingly engaged with the female screw members, the balancers being housed in the balancer housings from a backface side of the head body, respectively;

at least one fitting recess which is formed in the backface side of the head body so as to be displaced upward or downward from a center of the connecting hole; and a gravity center height adjustment balancer having an end which is fitted with the fitting recess so as to be removable, and wherein the information on the third-dimensional gravity center position stored on the IC chip includes at least one of materials, densities and mass of each balancer and/or the gravity center height adjustment balancer and an arrangement of the balancer and gravity center adjustment balancer.

4. The golf club according to claim 3, wherein user's personal information and information on specification of the golf club head are stored on the IC chip.

5. The golf club according to claim 1, wherein user's personal information and information on specification of the golf club head are stored on the IC chip.

6. The golf club according to claim 2, wherein user's personal information and information on specification of the golf club head are stored on the IC chip.

7. The golf club according to claim 1, wherein the balance adjustment portions include respective backface side balance adjustment portions each of which has:

a balancer housing formed in a toe or heel side of a backface side of the head body;

a cover detachably covering the balancer housing;

a female screw accommodating recess formed in a clubface side of the clubface recess so as to correspond to a position of the balancer housing;

a female screw member detachably fitted into the female screw accommodating recess;

a connecting hole which connects the female screw accommodating recess and the balancer housing portion;

a balancer fixture inserted through insertion holes of the balancers and the connecting holes, being threadingly engaged with the female screw members, the balancers being housed in the balancer housings from a backface side of the head body, respectively;

at least one fitting recess which is formed in the backface side of the head body so as to be displaced upward or downward from a center of the connecting hole; and a gravity center height adjustment balancer having an end which is fitted with the fitting recess so as to be removable, and wherein the information on the third-dimensional gravity center position stored on the IC chip includes at least one of materials, densities and mass of each balancer and/or the gravity center height adjustment balancer and an arrangement of the balancer and gravity center adjustment balancer.

8. The golf club according to claim 7, wherein user's personal information and information on specification of the golf club head are stored on the IC chip.

9. A golf club, comprising:

a golf club head including a head body and a pair of balance adjustment portions formed in the head body;

a plurality of weights detachably retained in each balance adjustment portion of the pair of balance adjustment portions so that a three-dimensional gravity center position of the golf club head is adjusted, the plurality of weights serving as balancers and differing from each other in density and mass; and an Integrated Circuit (IC) chip accommodating portion that is formed in the head body or one of the balance adjustment portions to house an IC chip that stores information on the three-dimensional gravity center position of the golf club head, wherein the balance adjustment portions include respective backface side balance adjustment portions each of which has:

a balancer housing formed in a toe or heel side of a backface side of the head body;

a cover detachably covering the balancer housing;

a female screw accommodating recess formed in a clubface side of a clubface recess so as to correspond to a position of the balancer housing;

a female screw member detachably fitted into the female screw accommodating recess;

a connecting hole which connects the female screw accommodating recess and the balancer housing portion;

a balancer fixture inserted through insertion holes of the balancers and the connecting holes, being threadingly engaged with the female screw members, the balancers being housed in the balancer housings from a backface side of the head body, respectively;

at least one fitting recess which is formed in the backface side of the head body so as to be displaced upward or downward from a center of the connecting hole; and a gravity center height adjustment balancer having an end which is fitted with the fitting recess so as to be removable, and wherein the information on the third-dimensional gravity center position stored on the IC chip includes at least one of materials, densities and mass of each balancer and/or the gravity center height adjustment balancer and an arrangement of the balancer and gravity center adjustment balancer.

10. The golf club according to claim 9, further comprising the IC chip accommodated in the IC chip accommodating portion.

11. The golf club according to claim 10, wherein user's personal information and information on specification of the golf club head are stored on the IC chip.

12. The golf club according to claim 9, wherein user's personal information and information on specification of the golf club head are stored on the IC chip.

* * * * *